US011114072B2

(12) United States Patent
White

(10) Patent No.: US 11,114,072 B2
(45) **Date of Patent: *Sep. 7, 2021**

(54) GUITAR SUPPORT PAD AND PLAYING METHOD

(71) Applicant: Carter B. White, Irvive, CA (US)

(72) Inventor: Carter B. White, Irvive, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/825,272

(22) Filed: Mar. 20, 2020

(65) Prior Publication Data

US 2020/0219472 A1 Jul. 9, 2020

Related U.S. Application Data

(63) Continuation-in-part of application No. 16/170,778, filed on Oct. 25, 2018, now Pat. No. 10,629,174.

(51) Int. Cl.
*G10G 5/00* (2006.01)

(52) U.S. Cl.
CPC ..... *G10G 5/005* (2013.01)

(58) Field of Classification Search
CPC ..... G10G 5/005; G10D 1/08; G10D 3/00
See application file for complete search history.

(56) References Cited

U.S. PATENT DOCUMENTS 4,084,584 A * 4/1978 Detty ..... A61F 13/061 2/24
4,457,032 A * 7/1984 Clarke ..... B60N 2/60 297/219.1
6,189,158 B1 * 2/2001 Lehoux ..... A45C 13/38 2/1
9,495,945 B1 * 11/2016 George ..... G10G 5/005

* cited by examiner

*Primary Examiner* — Kimberly R Lockett
(74) *Attorney, Agent, or Firm* — Stetina Brunda Garred & Brucker

(57) ABSTRACT

A guitar pad include a sheet of flexible material including a peripheral edge and a middle region extending entirely and continuously within the peripheral edge. The middle region includes surface area dimensions substantially greater than the thickness of the sheet, a first surface that is compressible, and a second surface which is at least partially conformably drapable over a portion of a guitar.

20 Claims, 6 Drawing Sheets

GUITAR SUPPORT PAD AND PLAYING METHOD

CROSS-REFERENCE TO RELATED APPLICATIONS

The present application is a continuation-in-part of U.S. patent application Ser. No. 16/170,778, filed Oct. 25, 2018, the contents of which are expressly incorporated herein by reference.

STATEMENT RE: FEDERALLY SPONSORED RESEARCH/DEVELOPMENT

Not Applicable

BACKGROUND

A. Field of the Invention

The present disclosure relates to musical instruments and methods for playing them. More particularly, the disclosure relates to a guitar support pad and method of using the pad to prevent the upper edge a guitar from digging into a torso of a guitar player.

B. Description of Background Art

Estimates of the number of guitar players in the United States and worldwide vary substantially, but reasonable estimates include about 40 million players in the United States alone, and at least 260 million worldwide. Professional musicians typically play guitars while standing. However, certain performances utilize seated guitar players. A majority of amateur musicians typically play the guitar in a seated position.

Playing a guitar while seated is usually more comfortable for a musician than playing in a standing position. A seated guitar player typically rests the body of a guitar on an upper surface of the thigh region of a player's leg, strumming or picking the guitar strings with the hand located on the same side as the supporting thigh, and maintains the guitar in place by grasping the neck of the guitar with the opposite hand.

Although playing a guitar while seated is generally more comfortable and less fatiguing than playing in a standing position, there are certain problems associated with the seated position. Specifically, there may be a tendency for a guitar to dig into the supporting thigh, or to slide on the surface of the thigh or on an item of clothing, such as a trouser leg, that covers the leg. These problems may be aggravated by humid environments, which can make surfaces more slippery. Additional discomfort may arise at the guitar player's ribcage area of the torso, wherein an upper rear edge of the guitar may be pressed against the guitar player when playing the guitar. The present disclosure was conceived of at least in part as a solution to such problems associated with playing a guitar in a seated position, by providing a novel guitar support pad and method for playing a guitar using the pad. Various aspects of the present disclosure address this particular need, as will be discussed in more detail below.

BRIEF SUMMARY

An object of the present disclosure is to provide a guitar support pad for increasing the positional stability of a guitar supported on a thigh of a seated musician's leg, and preventing the guitar from digging into the thigh.

Another object of the disclosure is to provide a lightweight guitar support pad which will not interfere with a guitar player's strumming or picking motions.

Another object of the disclosure is to provide a guitar support pad that has generally the shape of the a thin, flat, pad which is sufficiently flexible to be conformable to the upper surface of a musician's thigh, the pad having a soft upper surface that is effective in supporting the body of a guitar and maintaining the guitar in a desired position.

Another object of the disclosure is to provide a guitar support pad that has an upper surface which is effective in supporting and maintaining the body of a guitar in a desired playing position on a musician's thigh, and a lower surface which provides a comfortable contact with a musician's thigh or an item of clothing overlying the thigh, while having sufficient frictional resistance to inhibit sliding movement of the pad relative to the musician's leg.

Another object of the disclosure is to provide a method of using a guitar support pad to facilitate playing a guitar by a seated musician.

Various other objects and advantages of the present disclosure will become apparent to those skilled in the art by perusing the accompanying specification, drawings and claims.

It is to be understood that although the subject of the disclosure herein is fully capable of achieving the objects and providing the advantages described, the characteristics of the disclosure described herein are merely illustrative of the preferred embodiments. Accordingly, the scope of the exclusive rights and privileges in the disclosure may not be limited by the embodiment(s) described herein. It is intended that equivalents, adaptations and modifications to the disclosure reasonably inferable from the description contained herein be included within the scope of the disclosure.

Briefly stated, the present disclosure comprehends a guitar support pad for placement on the leg of a seated musician and supporting the body of a guitar, and a method of playing a guitar using the guitar support pad.

A guitar support pad according to the present disclosure includes a thin, flexible pad of an appropriate size and sufficient flexibility to enable draping the pad over the thigh of a seated musician. According to the disclosure, the guitar support pad has a soft upper surface which is effective in supporting the body of a guitar in a position desired by a musician, minimizing sliding motions of the guitar body from a desired position, and preventing the guitar from digging into the player's thigh. The upper surface of the guitar support surface is preferably made of a soft, resilient material to minimize the possibility of marring surfaces of the guitar body.

According to the disclosure, the guitar support pad has a lower surface that is sufficiently flexible to enable the pad to be conformable to the curved upper surface of a seated musician's leg, and soft enough to comfortably contact the leg directly, or contact the surface of part of an item of clothing, such as a trouser leg.

The guitar support pad according to the present disclosure is made of a material which gives the lower surface of the pad a comfortable soft surface that has a sufficiently large coefficient of sliding friction relative to the human skin and clothing fabrics to minimize any tendency for the guitar pad to slide or slip away from a desired position on a musician's leg.

A guitar support pad according to the present disclosure has a flexible soft, resilient upper surface, and a flexible, soft lower surface that has a sufficiently high surface coefficient of sliding friction to minimize sliding movement of a guitar support pad from a desired position on a bare leg or an article of clothing covering the leg.

According to one embodiment of the present disclosure, a guitar support pad is provided which has a composite structure, including a flexible, relatively thick, soft, resilient upper layer or laminate, and a flexible, relatively thinner lower layer which may be somewhat harder than the upper laminate.

A preferred embodiment of guitar support pad according to the present disclosure is fabricated as a rectangular plan-view sheet of tanned sheepskin having a width of about 11 inches and a depth of about 7 inches. An example embodiment of a guitar support pad according to the present disclosure was made from an 11 inch by 7 inch rectangular piece of tanned sheepskin. The lower, tanned leather part of the sheepskin has a thickness of about $1/16^{th}$ inch, and the upper wool part of the sheepskin had a thickness of about 1 inch.

A method of playing a guitar using the guitar support pad according to the present disclosure comprises the following steps. First, the guitar support pad is placed on the upper thigh part of a leg, e.g., the right leg, of a seated musician, with the long dimension of the pad perpendicular to the leg, and draped conformally over the leg. Next, the body of a guitar is set down by the musician at a desired location of the upper, wool surface of the guitar support pad. With the body of the guitar thus positioned, the upper end of the neck of the guitar is gripped by the hand on the opposite side of the musician's body, e.g., the left hand, that is also used to press strings of the guitar against frets in a conventional manner. The hand closest to the body of the guitar is then used to pick or strum the guitar strings in a conventional manner.

According to another embodiment, there is provided a guitar pad comprising a sheet of flexible material including a peripheral edge and a middle region extending entirely and continuously within the peripheral edge. The middle region includes surface area dimensions substantially greater than the thickness of the sheet, a first surface that is compressible, and a second surface which is at least partially conformably drapable over a portion of a guitar.

The guitar pad may include an attachment strap attached to the sheet of flexible material and extendable therefrom. A hook may be connected to the attachment strap and configured to be engageable with the guitar.

According to yet another embodiment, there is provided a method of using a guitar pad to facilitate playing a guitar. The method includes draping a guitar pad conformably over a portion of a guitar, with guitar pad including opposing first and second surfaces, a peripheral edge and a middle region extending entirely and continuously within the peripheral edge. The guitar pad is draped with said second surface of the guitar pad facing the guitar. The method additionally includes positioning the guitar at a desired position relative to a user, such that at least a portion of the guitar pad is positioned between the guitar and the user, with at least a portion of the first surface facing the user.

The method may additionally include extending an attachment strap away from a body of the guitar support pad toward a guitar opening formed on the guitar. The method may further comprise attaching a hook to the guitar, with the hook being connected to the attachment strap.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of a guitar support pad and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Figure 8:
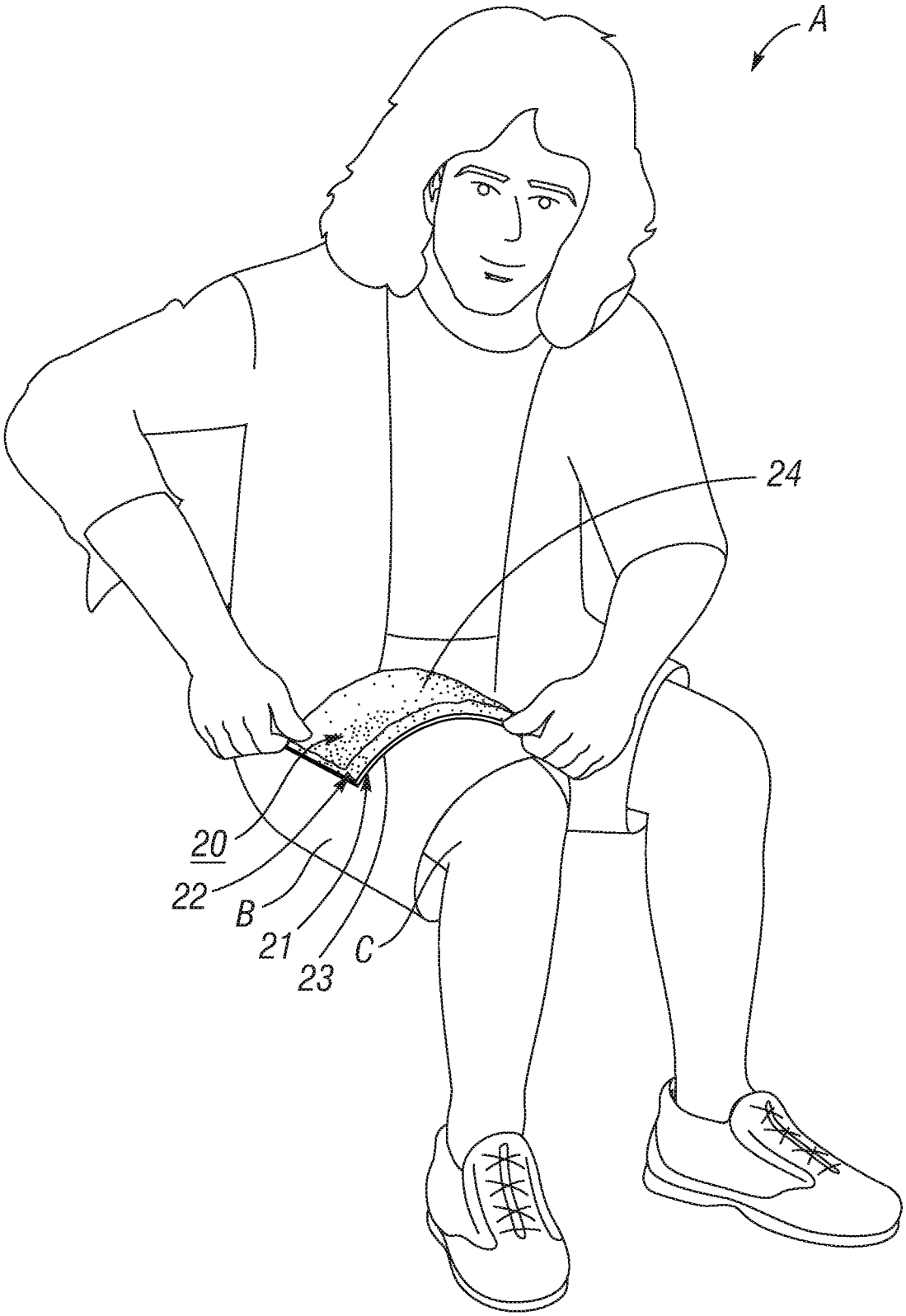
FIG. 8 is a perspective view showing the method of placing the guitar support pad of FIGS. 1-7 on the upper surface of the right thigh of a musician.
Figure 9:
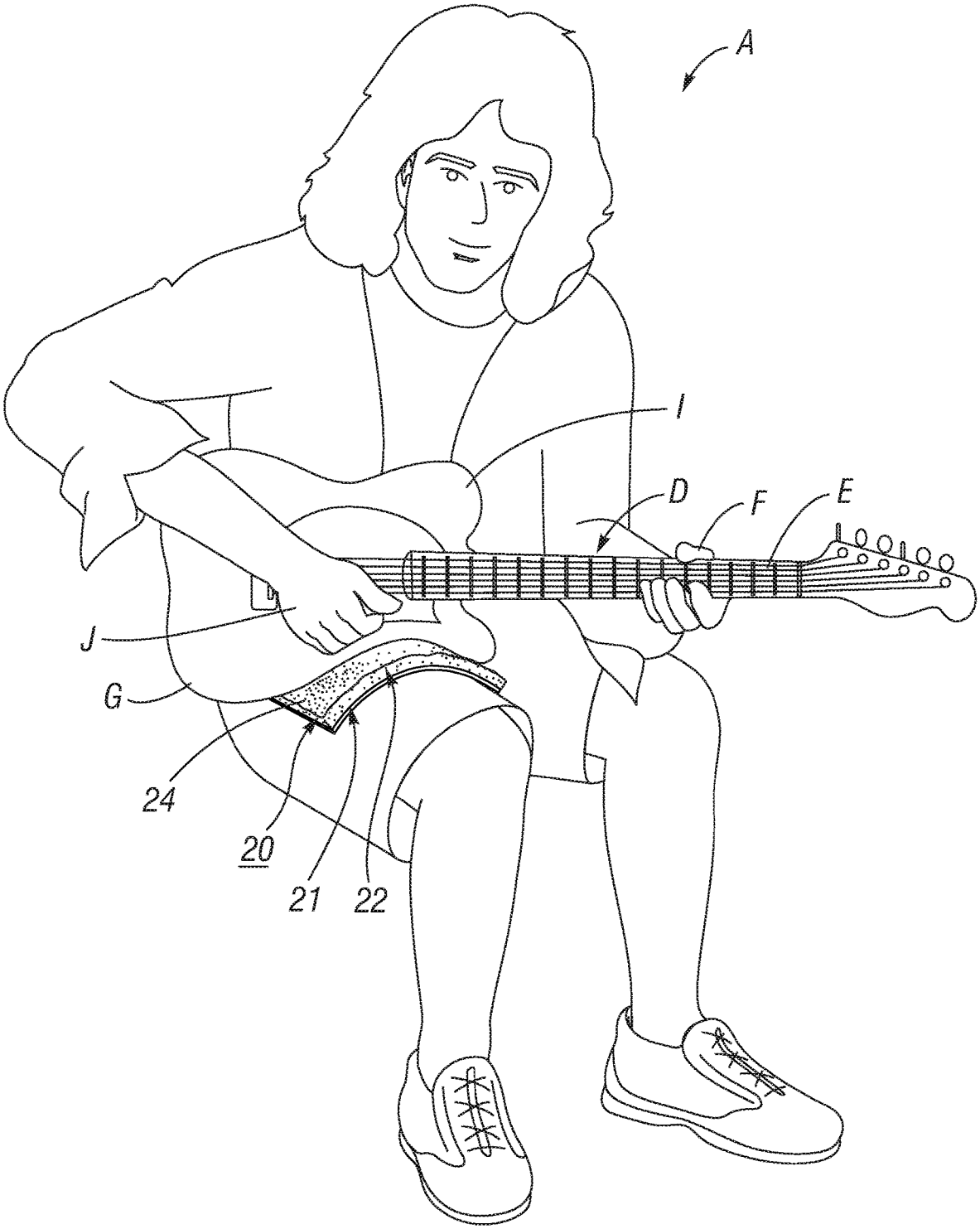
FIG. 9 is a perspective view showing the manner of using the support pad of FIGS. 1-8.

FIGS. 1-7 illustrate a preferred embodiment of a guitar support pad according to the present disclosure, and FIGS. 8-9 illustrate a method of playing a guitar according to the present disclosure.

Figure 1:
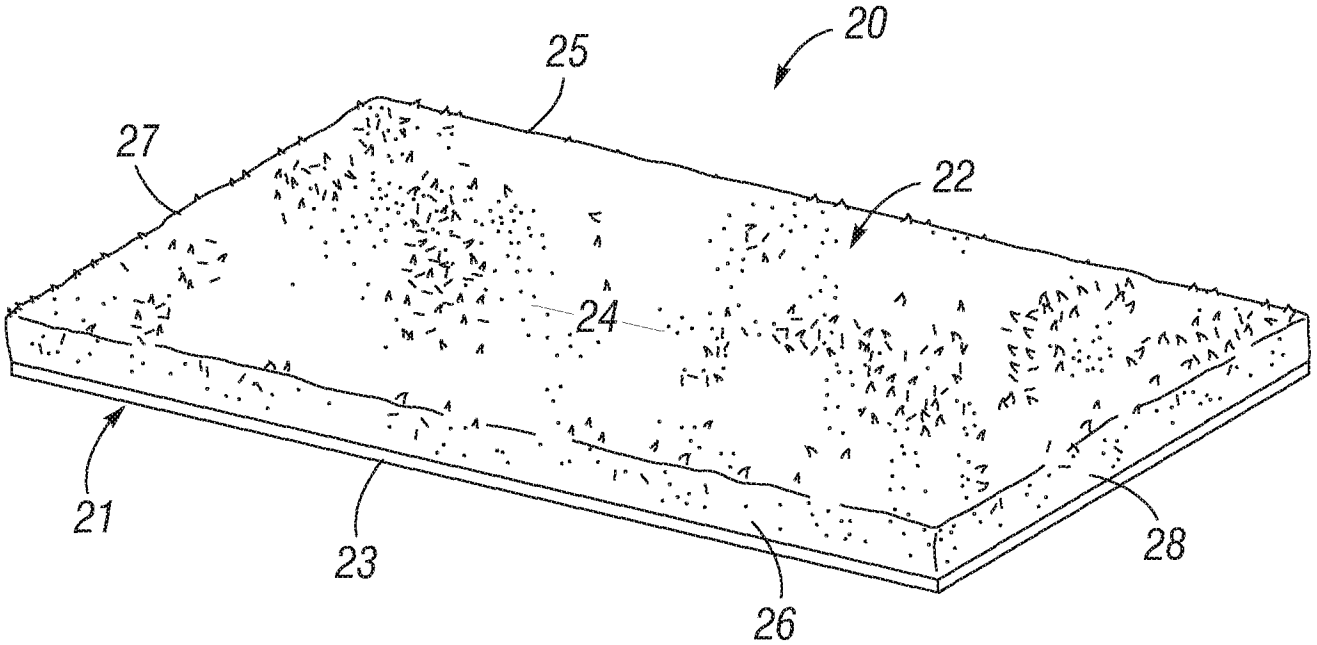
FIG. 1 is a perspective view of the guitar support pad according to the present disclosure.

Referring first to FIGS. 1-7, it may be seen that a guitar pad 20 according to the present disclosure has generally the shape of a thin, rectangularly-shaped slab. As shown in FIG. 1, guitar support pad 20 preferably has a laterally elongated, rectangular plan view shape. Although the dimensions of pad 20 are not critical, suitable dimensions for the pad may include a width of about 11 inches and a depth of about 7 inches. And although a preferred embodiment of pad 20 shown in FIG. 1 has a rectangular plan-view outline, different outline shapes may also be used. Thus some or all of the four corners of the rectangular pad 20 could be rounded off into arcuately-curved shapes and still accomplish the objectives of the present disclosure.

As shown in FIG. 1, guitar support pad 20 has a heterogenous, composite structure that includes a thin, rectangularly-shaped base panel 21 and a thicker upper padding section 22. Preferably, both upper padding section 22 and base panel 21 are made of soft, flexible materials. As will be explained later, both upper padding section 22 and base panel 21 should be flexible so that guitar support pad 20 may be draped conformally over the thigh of a seated guitar player. Also, the outer, lower surface 23 of base panel 21 should have a sufficiently large coefficient of friction so that it does not have a tendency to slide too easily on the surface of a guitar player's thigh, or on clothing covering the thigh.

In addition to a requirement of flexibility, upper padding section 22 of guitar support pad 20 should provide a soft, resilient, non-slip support surface for the body of a guitar supported by the pad. Accordingly, upper surface 24 of upper padding section 22 preferably is made of a soft, resilient material that is capable of providing a suitable support surface for a guitar body.

Preferably, guitar support surface 24 of guitar support pad 20 has a reasonably good water absorption characteristics. That property would be desirable because it has been found that playing a guitar while seated in a warm, humid environment can result in an excessive amount of condensation moisture forming on the body of the guitar, increasing the tendency of the guitar to slide away from a desired location on the player's thigh.

It is contemplated that a novel and highly effective composite support pad that has the desired characteristics identified above can be manufactured from a tanned sheepskin. An example embodiment of a guitar support pad 20 according to the present invention was fabricated from a sheepskin having a relatively thin leather hid part having a thickness of about $1/16^{th}$ inch, and a relatively thicker outer wool part having a thickness of about 1 inch.

Figure 2:
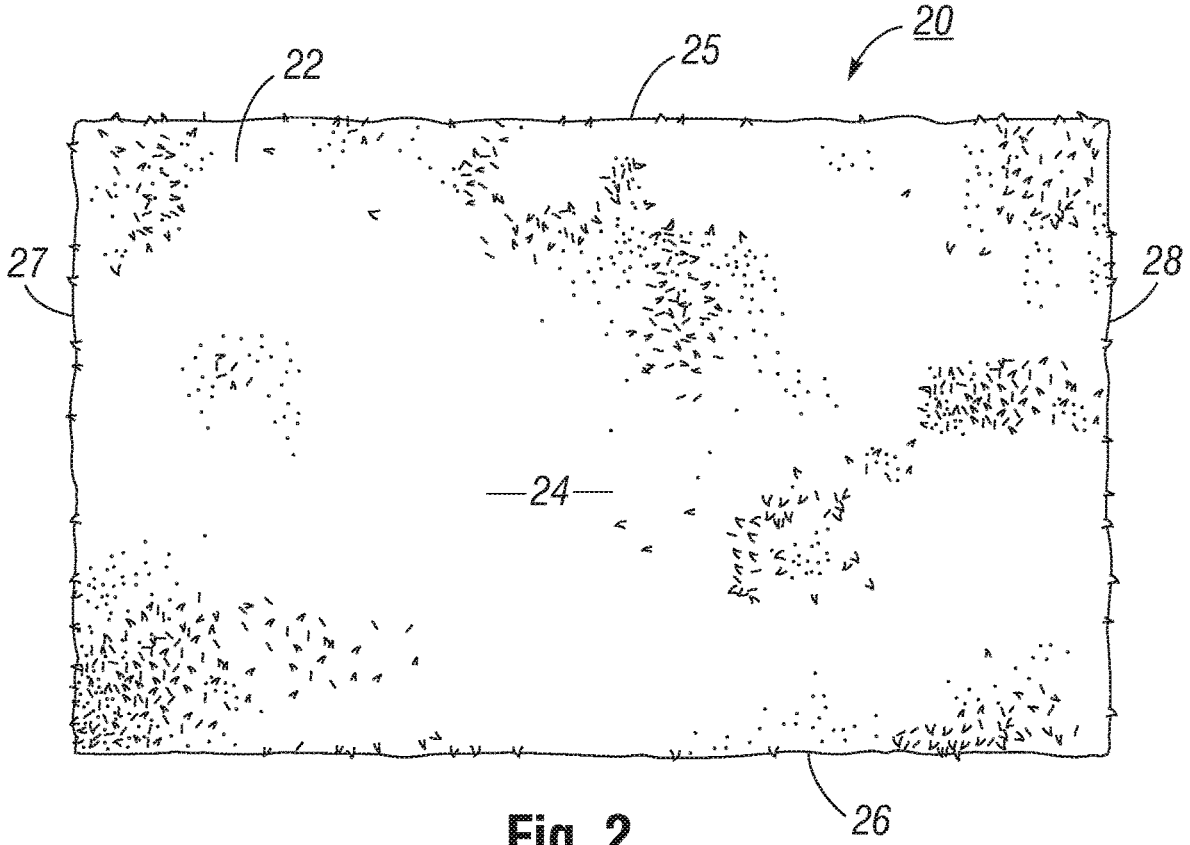
FIG. 2 is a top plan view thereof.
Figure 3:
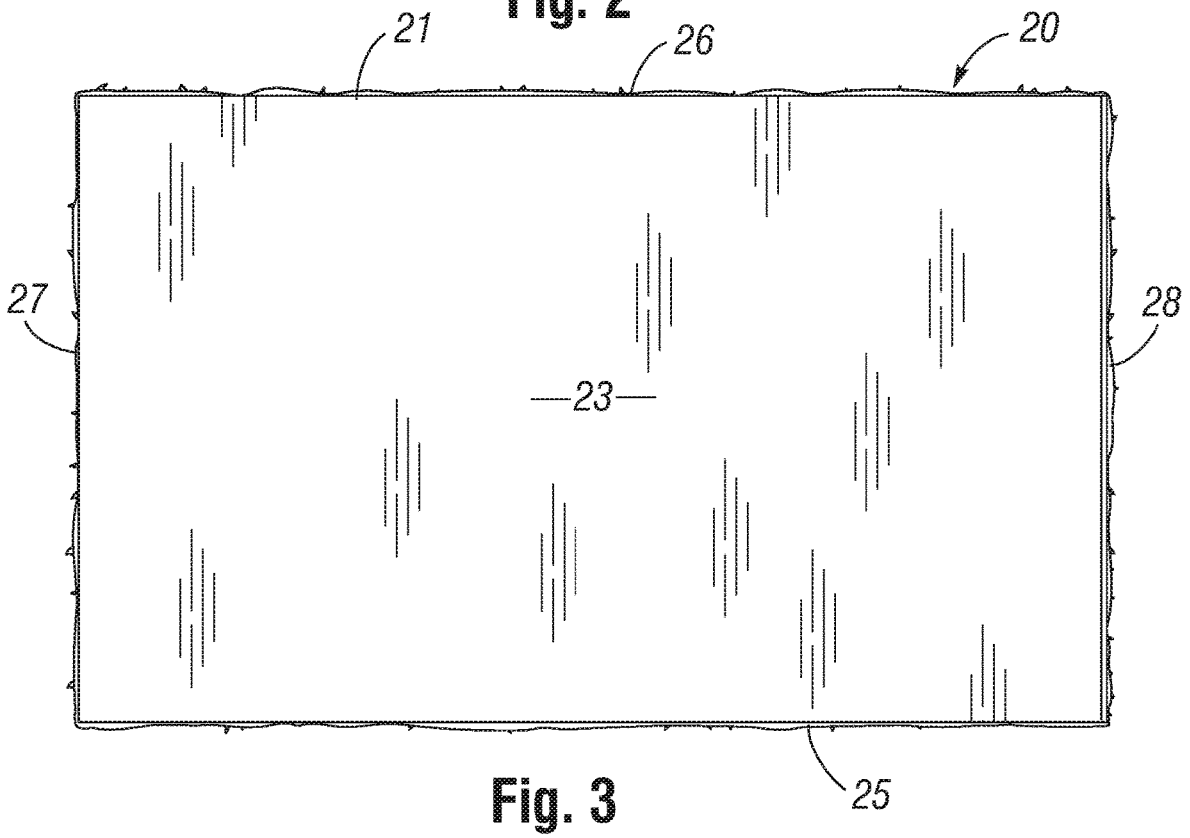
FIG. 3 is a bottom plan view thereof.
Figure 4:
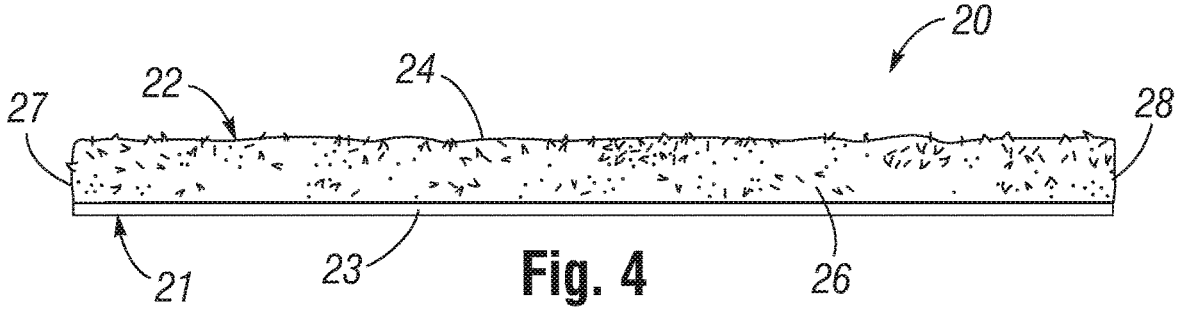
FIG. 4 is a front elevation view thereof.
Figure 5:
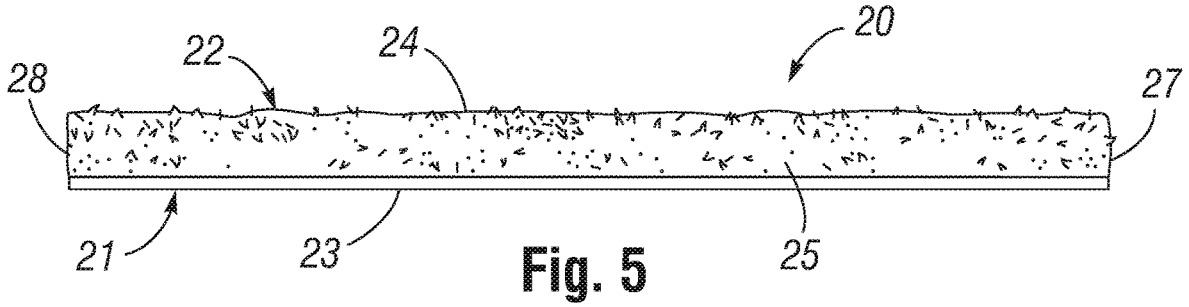
FIG. 5 is a rear elevation view thereof.
Figure 6:
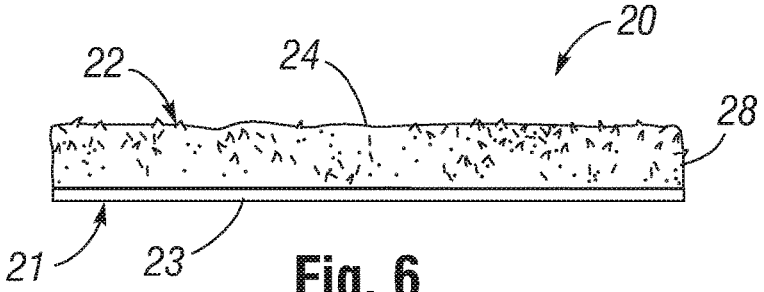
FIG. 6 is a right-side elevation view thereof.
Figure 7:
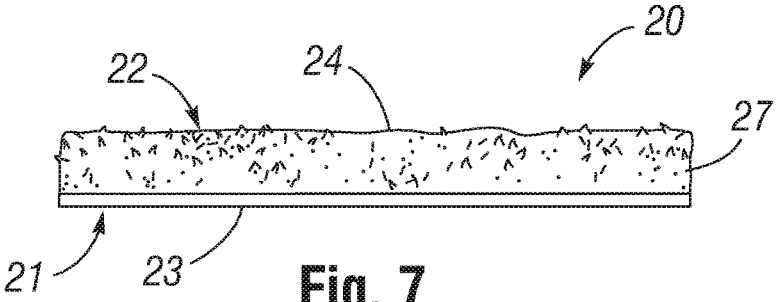
FIG. 7 is a left-side elevation view thereof.

As shown in FIGS. 1 and 2, an example embodiment of a guitar support pad 20 according to the present disclosure has a laterally-elongated, rectangular shape. The pad 20 has a straight rear side 25 having a length of about 11 inches, a straight front side 26 parallel to and having the same length as the rear side, a left side 27 perpendicular to the front and rear sides having a length of about 7 inches, and a right side 28 parallel to the left side and having the same length. The example embodiment of guitar support pad 20 had a total thickness of about 1 1/16 inches.

FIGS. 8 and 9 illustrate a method of playing a guitar using the guitar support pad 20 according to the present disclosure.

The following description applies to the use of guitar support pad 20 by a right-handed guitar player playing a right-handed guitar. It will be understood that guitar pad 20 is interchangeably usable by a left-handed player playing a left-handed guitar.

Referring first to FIG. 8, a seated right-handed guitar player A is shown placing guitar support pad 20 on a right trouser leg B covering the players right thigh C. Next, as shown in FIG. 9, guitar player A grasps the neck E of a guitar D in the player's left hand F, and places the outer, finger-side side wall G of the guitar body H on the upper surface 24 of guitar support pad 20.

As shown in FIG. 9, the arcuately-curved indentation I in outer, finger-side side wall G of guitar body H is conformally supported by the upper surface 24 of guitar support pad 20. The upper surface 24 of guitar support pad 20 is convexly curved as a result of pad 20 being draped conformally over the player's thigh. With this arrangement, guitar player A is enabled to play guitar D in a conventional fashion, pressing strings against frets with the left hand and strumming or picking lower parts of the strings with the right hand, with the guitar held securely in place on the player's thigh by the resilient, non-slip support provided by guitar support pad 20.

Figure 10:
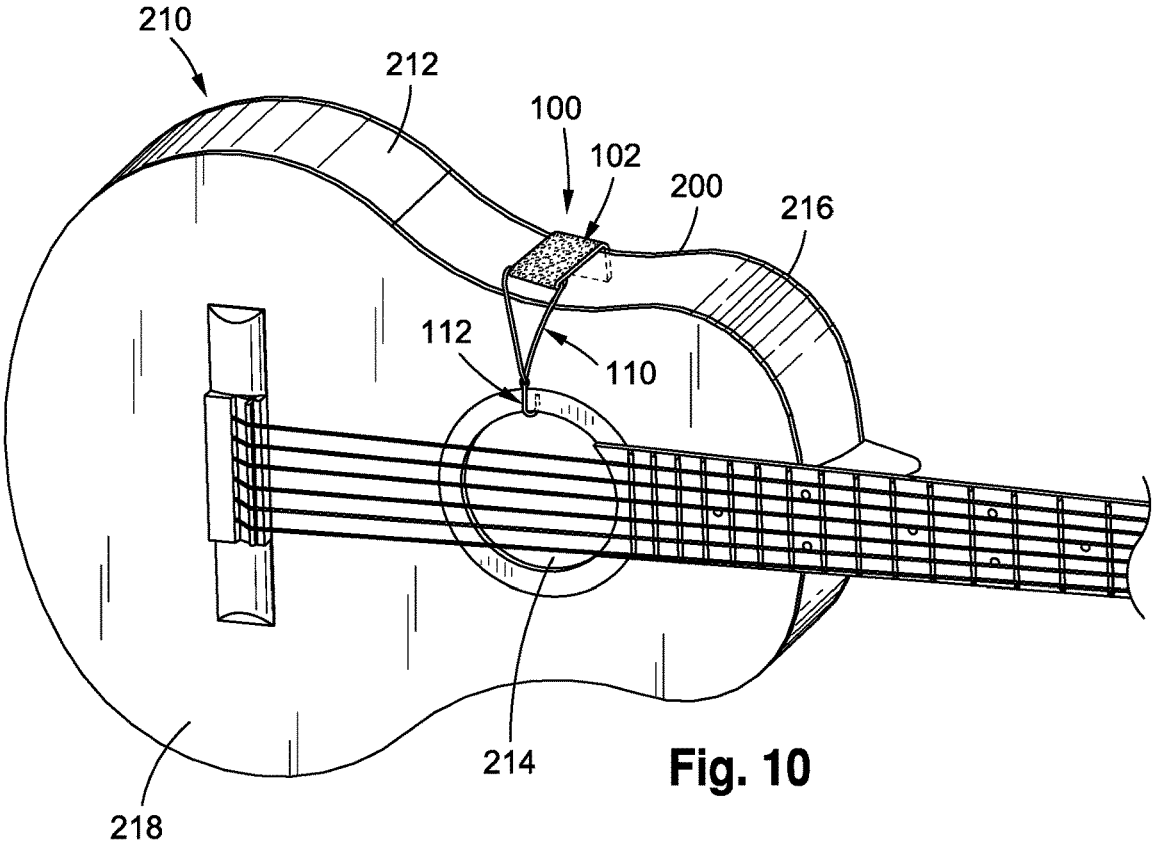
FIG. 10 is an upper perspective view of a guitar pad connected to an acoustic guitar for providing a more comfortable interface between the guitar and a torso of a seated guitar player.
Figure 11:
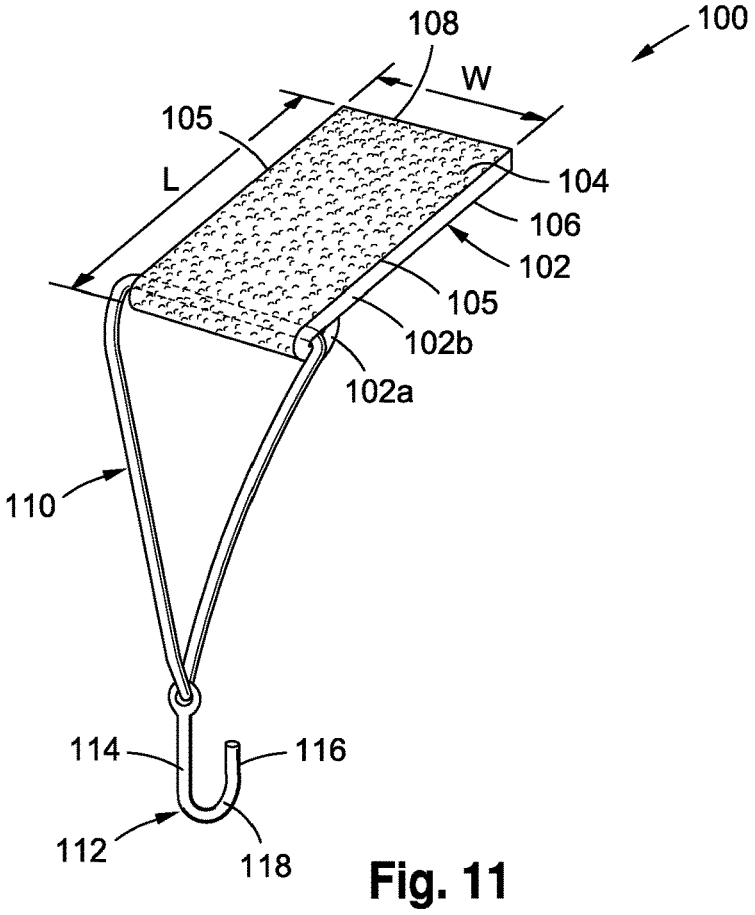
FIG. 11 is an upper perspective view of the guitar pad depicted in FIG. 10.

Referring now to FIGS. 10 and 11 there is depicted a guitar pad 100 specifically configured and adapted to enhance the comfort of a seated guitar player. More specifically, the guitar pad 100 may be placed so as to extend over an upper rear edge 200 of an acoustic guitar 210, such that when the seated guitar player plays the guitar 210, the guitar pad 100 is pressed against the guitar player's ribcage area, rather than the harder, sharper edge 200 of the guitar 210. The soft, comfortable qualities of the guitar pad 100 provide for a far more comfortable guitar playing experience, particularly when playing a guitar 210 over longer periods of time.

According to one embodiment, the guitar pad 100 includes a body 102 having an upper surface 104 and a lower surface 106. The composition of the upper and lower surfaces 104, 106 may be similar to the pad 20 discussed above. In this regard, the guitar pad 100 may be fabricated from a sheepskin having a relatively thin leather hide part (which defines the lower surface 106) having a thickness of about $1/16^{th}$ inch, and a relatively thicker outer wool part (which defines the upper surface 104) having a thickness of about 1 inch.

The guitar pad 100 may additionally include a first end portion and a second end portion and a pair of side edges 105 extending in generally parallel relation to each other between the first and second end portions. The first end portion terminates to define a first end edge 108. The distance between the pair of side edges may define a width W, and the distance from the first end edge 108 to the terminal end of the second end portion may defined a length L. In the exemplary embodiment, the width W is equal to between 0.5 inches-8.0 inches, and more preferably approximately 3.0-4.0 inches, and the length L is equal to between 1.0 inch-12.0 inches, and more preferably approximately 5.0-7.0 inches. However, those skilled in the art will appreciate that other widths W and lengths L may be used without departing from the spirit and scope of the present disclosure.

The second end portion is configured to connect with an attachment strap 110, which is used for connecting the guitar pad 100 to the guitar 210. In the exemplary embodiment, the second end portion is connected to the attachment strap 110 by folding over a portion of the body 102 and securing the body 102 onto itself to define a passage through which the attachment strap 110 may extend. In this regard, the folded portion of the body 102*a* may extend between a portion of the attachment strap 110 and the guitar 210 during use to mitigate scratching of the guitar 210 by the attachment strap 110. The folded portion of the body 102*a* may be secured to the remaining portion of the body 102*b* via stitching, hooks and loops fastener (e.g., Velcro™), magnets, adhesives, welding, or other fasteners known in the art. It is also contemplated that the attachment strap 110 may be routed through eyelets or other openings extending through the upper and lower surfaces 104, 106 of the body 102 and knotted or tied to itself, or fastened using a clasp or other locking mechanisms.

The attachment strap 110 may be flexible and capable of extending from the body 102 of the guitar pad 100 to a hook 112 which may clip onto the guitar 210. The attachment strap 110 may be formed from a soft, non-abrasive, woven material, such as cotton, so as not to scratch the surface of the guitar 210. It is also contemplated that the attachment strap 110 may be formed from leather or other materials known in the art.

The hook 112 may include a first portion 114 and a second portion 116 joined to the first portion 114 by an elbow 118. The hook 112 may be extendable around the edge of the guitar 210 which defines a sound hole 214. The hook 112 may be generally rigid and substantially inflexible, such that the distance between the first and second portions 114, 116 remains generally constant. Alternatively, the second portion 116 may be configured similar to a clamp, wherein the distance between the first and second portions 114, 116 may be varied to allow the second portion 116 to transition relative to the first portion 114 between a clamping position and a release position, wherein the distance between the second portion 116 and the first portion 114 decreases as the second portion 116 transitions from the release position to the clamping position. The clamping action of the hook 112 may allow the hook 112 to apply a gripping force on the guitar 210 to hold the hook 112 in place during use. The magnitude of any gripping force may be small enough so as not to damage the guitar 210. Furthermore, the hook 112 may include a soft external surface, such as a rubber coating, so as to mitigate scratching or damage to the guitar 210.

With the basic structure of the guitar pad 100 described above, the following discussion relates to an exemplary use of the guitar pad 100. Prior to playing the guitar 210, a guitar player installs the guitar pad 100 on the guitar 210 by placing the guitar pad 100 on the guitar 210. In particular the second end portion is placed over a side wall 212 of the guitar 210, preferably above the sound hole 214, with the guitar pad 100 extending over the rear edge 200 of the guitar 210 and the first end portion hanging downwardly from the rear edge 200 and extending over a portion of the rear surface 216 of the guitar 210.

The hook 112 is attached to the guitar body, such that the hook 112 extends around the edge defining the sound hole 214 and the second portion 116 of the hook 112 extends into the cavity of the guitar 210 and the first portion 114 extends outside of the guitar 210. If the second portion 116 is flexible relative to the first portion 114, the second portion 116 may impart a compressive force on the guitar 210 to hold the hook 112 in place. The hook 112 and attachment strap 110 are configured to be very thin so as not to interfere with the guitar strings or the strumming action of the guitar player during use. In this regard, the first portion 114 of the hook 112 and the attachment strap 110 may be in contact with the forward face 218 of the guitar 210. In other words, the first portion 114 of the hook and the attachment strap 110 may reside in a first plane that is adjacent a second plane defined by the forward face 218 of the guitar 210 and spaced from a third plane defined by the strings.

When the hook 112 is in place, the guitar pad 100 may be moved away from the front face 218 of the guitar 210 so as to remove any slack in the attachment strap 110 and slightly increase the tension in the attachment strap 110. In such a position, the guitar pad 100 extends over a portion of the side wall 212 and a portion of the rear wall 216, as well as over a portion of the rear edge 200 at the intersection of the side wall 212 and rear wall 216. The guitar player may move into a playing position, with the player's torso pressing against the guitar pad 100, which compresses the guitar pad 100 between the guitar 210 and the player. The compression of the guitar pad 100 dissipates the force of the guitar player against the guitar 210 over a greater surface area, rather than having the rear edge of the guitar 210 pressed into the player's torso. Accordingly, the guitar pad 100 provides for a more comfortable interaction between the guitar player's torso and the guitar 210, particularly when the guitar 210 is played for an extended period of time.

When the guitar player has finished playing the guitar 210, the guitar player may remove guitar pad 100 from the guitar 210 by lifting the body of the guitar pad 100 off of the side wall 212 and away from the rear wall 216 of the guitar 210, and removing the hook 112 from the guitar 210. In this regard, the guitar pad 100 may be disengaged from the guitar 210 to facilitate storage of the guitar 210, as well as storage of the guitar pad 100.

Although the foregoing describes the guitar pad 100 as being secured to the guitar opening 214 commonly included in an acoustic guitar 210, it is understood that the scope of the present disclosure is not limited thereto. In this regard, the guitar pad 100 may be secured to the guitar via other mounting structures and with other attachment mechanisms known in the art. For instance, the guitar pad 100 may be secured to the neck of the guitar, or other structures on the guitar, particularly if the guitar is formed without a guitar opening 214.

It is also contemplated that one or more guitar pads 102 may be used when playing the guitar 210. For instance, one guitar pad 102 may be positioned at an upper portion of the guitar 210, while another guitar pad 102 may be positioned at a lower portion the guitar for providing padding between the lower portion of the guitar 210 and the guitar player. The pair of guitar pads 102 may be connected via a common attachment strap 110 which may have a pair of ends that connect to diametrically opposed portions of the guitar opening 214. In particular, one end of the attachment strap 110 may be connected to a hook 112 that connects to an upper end of the guitar opening 214, while the other end of the attachment strap 110 is connected to another hook 112 that connects to a lower end of the guitar opening 214. It is also contemplated that the attachment strap 110 may be formed of an elastic material, which may allow the attachment strap 110 to be stretched to remove any slack and to allow the strap 110 to assume a flush, linear configuration that does not interfere with the strings or the strumming action of the guitar player.

Although the foregoing describes the guitar pad 100 as being connectable to the guitar 210, it is contemplated that in other embodiments, the guitar pad 100 may be configured to be worn by the guitar player. In this regard, the attachment strap 110 may be wearable around the guitar player's neck such that the pad body 102 hangs at a location which provides protection to the guitar player's torso, and more specifically, the ribcage area, when the guitar player is seated and playing the guitar.

The particulars shown herein are by way of example only for purposes of illustrative discussion and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A guitar pad comprising a sheet of flexible material including a peripheral edge and a middle region extending entirely and continuously within the peripheral edge, wherein said middle region has surface area dimensions substantially greater than the thickness of the sheet, a first surface that is compressible, and a second surface which is at least partially conformably drapable over a portion of a guitar.

2. The guitar pad of claim 1, further comprising an attachment strap attached to the sheet of flexible material and extendable therefrom.

3. The guitar pad of claim 2, further comprising a hook connected to the attachment strap and configured to be engageable with the guitar.

4. The guitar pad of claim 1, wherein said first surface is formed by a material having a fibrous texture.

5. The guitar pad of claim 1, wherein said second surface of said sheet has a coefficient of friction large enough to inhibit free sliding motion of said pad on an outer surface of the guitar.

6. The guitar pad of claim 1, wherein said sheet of material has a composite structure.

7. The guitar pad of claim 6, wherein said sheet of material has a laminated structure.

8. The guitar pad of claim 7, wherein said sheet of material includes an upper lamination made of a resiliently compressible material.

9. The guitar pad of claim 8, wherein said sheet of material includes a lower lamination made of a material which has a coefficient of friction large enough to inhibit free sliding motion of said pad on a guitar.

10. The guitar pad of claim 7, wherein said sheet of material includes a lower lamination made of a material which has a coefficient of friction large enough to inhibit free sliding motion of said pad on a guitar.

11. The guitar pad of claim 10, wherein said sheet of material includes an upper lamination made of resiliently compressible material, both the upper lamination and the lower lamination extending continuously and entirely within the peripheral edge, the lower lamination being thinner than the upper lamination.

12. A method of using a guitar pad to facilitate playing a guitar, said method comprising the steps of:

draping a guitar pad conformably over a portion of a guitar, said guitar pad including opposing first and second surfaces, a peripheral edge and a middle region extending entirely and continuously within the peripheral edge, the guitar pad being draped with said second surface of said pad facing the guitar; and positioning the guitar at a desired position relative to a user, such that at least a portion of the guitar pad is positioned between the guitar and the user, with at least a portion of the first surface facing the user.

13. The method recited in claim 12, further comprising the step of extending an attachment strap away from a body of the guitar pad toward a guitar opening formed on the guitar.

14. The method recited in claim 13, further comprising the step of attaching a hook to the guitar, the hook being connected to the attachment strap.

15. A guitar pad for use by a seated guitar player comprising essentially of a tanned sheepskin, said tanned sheepskin including a peripheral edge and a middle region extending entirely and continuously within the peripheral edge and having generally a size and shape which enable said sheepskin to be draped over a portion of a guitar, said sheepskin having a wooly section for interfacing with a user and a tanned leather section for placement on the guitar.

16. The guitar pad of claim 11 wherein said woolly section of said sheepskin has a thickness in the approximate range of about ¾ inch to about 1½ inch.

17. The guitar pad of claim 12 wherein said tanned leather section has a thickness in the approximate range of about $1/16^{th}$ inch to about ⅛ inch.

18. The guitar pad of claim 11 wherein said tanned leather section has a thickness in the approximate range of about $1/16^{th}$ inch to about ⅛ inch.

19. The guitar pad of claim 14 wherein said wooly section of said sheepskin has a thickness in the approximate range of about ¾ inch to about 1½ inch.

20. The guitar pad of claim 11 wherein said sheepskin has a quadrangular shape.

* * * * *